US007488282B2

(12) United States Patent
Leavitt

(10) Patent No.: US 7,488,282 B2
(45) Date of Patent: Feb. 10, 2009

(54) EXERCISE DEVICE

(76) Inventor: Shannon Leavitt, 6026 Wentworth Ave. South, Minneapolis, MN (US) 55419-2335

( * ) Notice: Subject to any disclaimer, the term of this patent is extended or adjusted under 35 U.S.C. 154(b) by 9 days.

(21) Appl. No.: 11/600,600

(22) Filed: Nov. 16, 2006

(65) Prior Publication Data

US 2007/0129226 A1 Jun. 7, 2007

Related U.S. Application Data

(60) Provisional application No. 60/737,066, filed on Nov. 16, 2005.

(51) Int. Cl.
*A63B 26/00* (2006.01)

(52) U.S. Cl. ..... 482/142; 482/140

(58) Field of Classification Search ..... 482/140, 482/142, 907, 121–130, 91, 52; D21/676, D21/686, 690
See application file for complete search history.

(56) References Cited

U.S. PATENT DOCUMENTS 3,893,667 A 7/1975 Snyder, Jr. et al.
5,226,865 A 7/1993 Chin
5,261,864 A 11/1993 Fitzpatrick
5,529,562 A 6/1996 Glaser
5,540,642 A 7/1996 Sprague
6,206,805 B1 3/2001 Helton et al.
6,245,001 B1 6/2001 Siaperas
6,558,301 B1 5/2003 Jackson
6,634,998 B2 * 10/2003 Siaperas ..... 482/142
6,908,417 B2 * 6/2005 Jackson ..... 482/52
7,150,703 B2 * 12/2006 Gary ..... 482/140
2006/0135332 A1 * 6/2006 Larson ..... 482/148

OTHER PUBLICATIONS

Gaiam Yoga Board product (http://galam.com/retail/product/95-1226) on Nov. 7, 2006 (2 pages).

* cited by examiner

*Primary Examiner*—Lori Amerson
(74) *Attorney, Agent, or Firm*—Popovich, Wiles & O'Connell, P.A.

(57) ABSTRACT

An exercise device and method of use thereof, including an exercise platform and an incline base that can be used together or separately. The exercise device can be used for aerobics, strength-training and yoga or a combination thereof. The exercise platform can be rectilinear U-shaped and can include pull rings and exercise tubes connected thereto and the incline base can be adjustable from a horizontal position to variable degrees of incline.

14 Claims, 12 Drawing Sheets

Fig. 3D
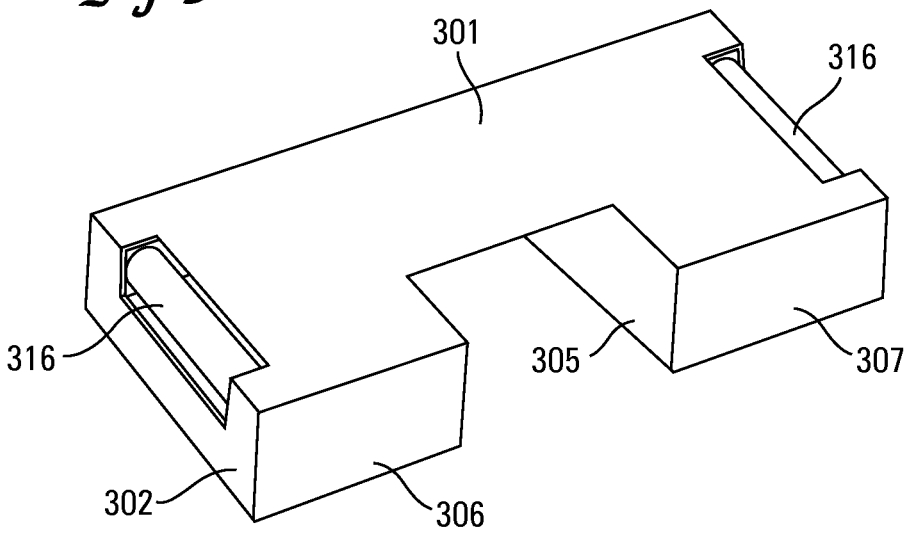
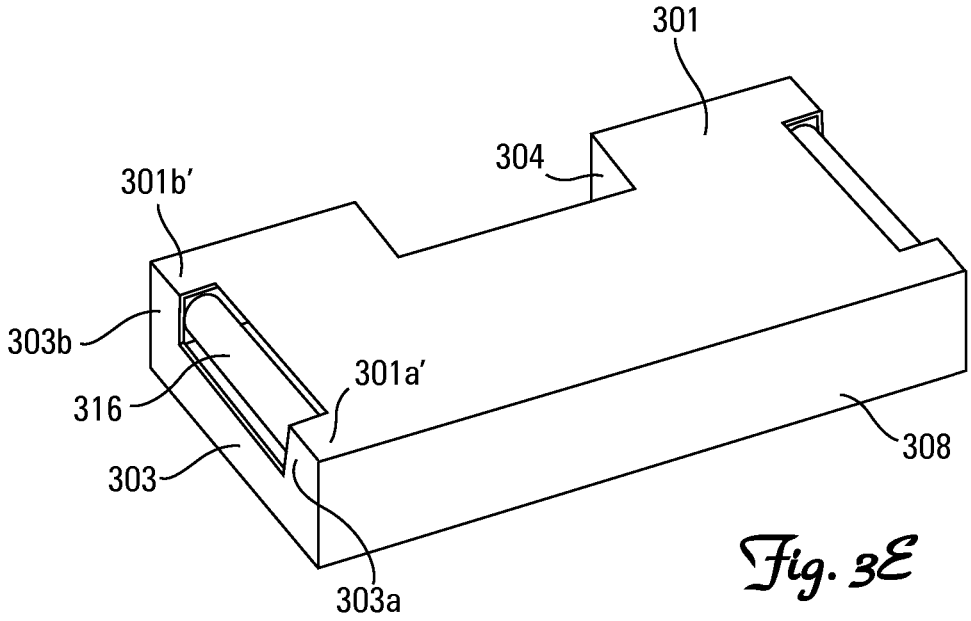
Fig. 3E

Fig. 7A
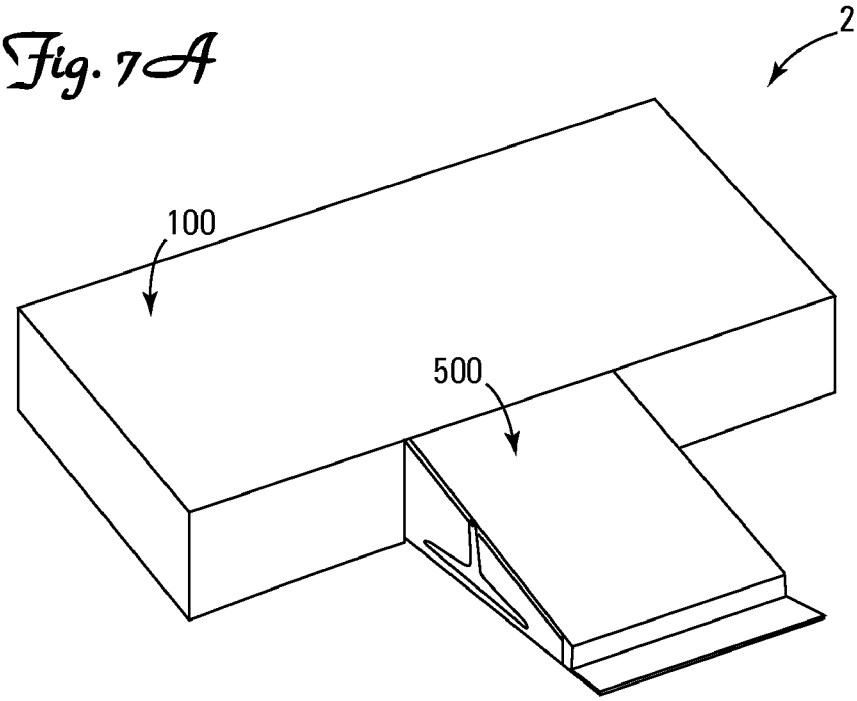
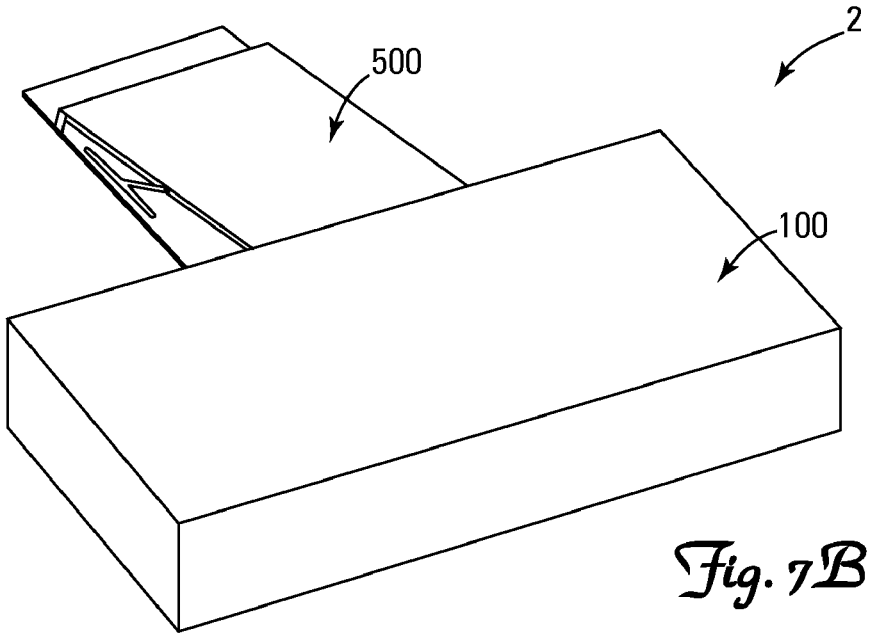
Fig. 7B

EXERCISE DEVICE

This application claims the benefit of U.S. Provisional Application No. 60/737,066, filed Nov. 16, 2005, entitled "Exercise Device", the contents of which are hereby incorporated by reference herein.

FIELD OF THE INVENTION

The present invention relates to a device for exercising. More particularly this invention relates to a yoga prop used for multidimensional exercises such as yoga, strength-training, aerobics and meditation.

BACKGROUND OF THE INVENTION

The use of indoor exercising equipment is well known in today's health-conscious world. Aerobic exercise devices in particular have been used. One example of such an aerobic exercise device is an apparatus that basically functions as a single step and is typically square or rectangular, having one raised platform or surface, and that allows a person to begin a series of step up and step down motions from the floor. While these devices work quite well, they are somewhat limited in the range of action and exercises permitted. A practitioner also cannot easily use the aerobic device for other dimensions of workouts, such as yoga, strength-training, or meditation. The practitioner is also not able to combine various workout techniques.

It is well known that a yoga practitioner must assume different postures for performing different yoga exercises. Since yoga exercises can be complicated to perform, a person who is going to start a yoga program may encounter many difficulties. Such a person may have no time for lengthy study, may not be sufficiently persistent, or may not have a trainer for providing competent help. The practitioner may also not have adequate flexibility to properly perform various poses or positions. Flexibility decreases as a person ages which produces decreased mobility and function ability and can increase likelihood of injury.

Meditation is an increasingly popular technique for stress reduction and/or spiritual growth. Meditation is practiced in many positions, including sitting, and reclining. Most meditation devices cannot be used for performing both the sitting and reclining positions or be used for combining various other workouts.

The fusion of aerobics, strength-training, yoga and meditation is an ideal venue for basic health, weight loss, and weight maintenance. It is now common knowledge that this society suffers from epidemic obesity levels. Aerobics and strength-training have long been known to aid fat loss and improve body composition. Yoga and meditation have more recently been understood to assist in weight loss, maintenance and improved body composition as well.

It would be desirable to provide a device for multidimensional workouts, such as yoga, strength-training, aerobics and meditation, which is inexpensive, easy to use, and permits: (1) different yoga and meditation postures and poses; (2) aerobic training in a simple and easy manner; and (3) strength-training.

It would further be desirable to provide a device for multidimensional workouts with one piece of equipment.

It would further be desirable to provide a device that meets the needs for an all around yoga prop and method of use which can be used to get inflexible practitioners into yoga poses and more flexible practitioners into deeper yoga poses which have the anatomically correct position required to accurately perform the pose for optimal gain and minimal injury.

SUMMARY OF THE INVENTION

The invention provides an exercise device and method of use thereof for multidimensional workouts such as yoga, aerobics, strength-training, and meditation.

The invention provides such an exercise device and method of use thereof with a wide range of versatility as to enable the practitioner to encompass a more diverse array of exercises. More particularly, the invention provides a device for yoga exercising so that yoga exercises may be safely and correctly executed, and progressively improved substantially independent from the practitioner's age, weight, inclination and ability.

In one embodiment the present invention provides an exercise platform which is elevated from the ground and has two exterior side walls, a back wall and two front walls, all of which are perpendicular to the floor, and a top surface that is parallel to the floor and is attached to the exterior side, back and front walls. The exercise platform of the present embodiment has a hollow recess which is the space enclosed by two interior side walls perpendicular to the floor and parallel to the exterior side walls, which both connect to the same back wall and separate front walls and is enclosed by the top surface. The hollow recess provides storage space as well as other functions for the incline base described hereinafter. The exercise platform may be used in combination with or separately from the above mentioned incline base of the present invention.

In one embodiment of the present invention the exercise platform has a rectilinear U-shape that is elevated to the height of a conventional human step, which, for example, can be from 4 inches (10.2 cm) to 12 inches (30.5 cm), and has two exterior side walls, a back wall and two front walls, all of which are perpendicular to the floor, and a top surface that is parallel to the floor and is attached to the exterior side, back and front walls. The exercise platform of this embodiment also has a hollow recess which is the space enclosed by two interior side walls perpendicular to the floor and parallel to the exterior side walls, which both connect to the same back wall and separate front walls and is partially enclosed by the top surface and not enclosed by a recessed portion of the top surface, the amount of top surface enclosing the hollow recess being determined by the removed area of the recessed portion, the recessed portion giving the exercise platform a rectilinear U-shape. The hollow recess is sized in length and width to permit sufficient volume and area where the practitioner may at least plant two feet on the ground within the hollow recess where the recessed portion of the top surface has been removed, with some space left over to permit active and vigorous step up and step down motions with one or two feet within the hollow recess. The hollow recess is also used for various other exercises that require some of the practitioner's body be positioned therein. The width of the hollow recess is determined to accommodate practitioners of varying size, and may be changed for different embodiments of the present invention. The exercise platform will also help the practitioner perform deeper and more difficult yoga poses, and also allows the inflexible practitioner to develop flexibility correctly and safely. More particularly, the exercise platform's hollow recess will enable the practitioner to intensify, practice, and deepen twists, postures, poses, and stretches by providing resistance and support and other useful benefits.

The exercise platform may also comprise exercise tubes fastened to the front, back, and side walls of the exercise platform. The exercise tubes are designed to be positioned inside rectilinear cavities which are created when recessed portions of the two sides of the top surface and upper ends of the two exterior side walls have been removed. The exercise tubes are used to enhance a stretch and to develop various workouts and routines.

The exercise platform may also comprise pull rings that can be attached to the exercise platform by fasteners located on the two back corners of the top surface or by fasteners attached to a fastener support located on the underside of the top surface. The pull rings fastened to the underside of the top surface can be thread through removed recessed portions of the interior and exterior side walls as well. The pull rings are used to help enhance and develop various exercise workouts and routines.

The invention provides an incline base that is adjustable to allow for varying degrees of incline, different flexibility levels of practitioners and which can be used in combination with or separately from the exercise platform of the present invention. The incline base can be used to enhance and develop various exercise routines such as yoga and meditation poses as well as other workouts. The incline base, when not being used, can be stored within the hollow recess of the exercise platform In an embodiment of the present invention, the incline base is used in combination with the exercise platform. More particularly, the combination exercise platform and incline base can be used as a yoga prop, which allows the practitioner to get into a yoga pose more deeply, and also allows the inflexible user to develop flexibility correctly and safely. The yoga prop develops and safely improves flexibility by adjusting the degree of the slope of the incline base and by also having the practitioner position themselves higher or lower on the incline base. The yoga prop can be used to combine various exercise routines and produce a fusion workout which is desirable and meets the needs of a busy, multi-tasking society. The yoga prop can enhance and develop various workouts and routines, more particularly the yoga prop can help perform: (1) numerous yoga sitting poses—by lifting the butt and hips so as to allow the practitioner to twist and bend forward from the hips, not the waist, thus not rounding the back preventing poor form and injury; (2) the Down Dog—by giving extension to the upper body by placing hands higher or lower on the incline base as the practitioner's flexibility will allow so as to help ground the practitioner's lower body; (3) ½ Bow Pose—by providing necessary lift so the practitioner can grab his/her foot and by supplementing with the exercise platform to push away from so as to intensify or deepen the pose; (4) Bow Pose—by providing lift so practitioner can grab both ankles, and by using the incline where the stomach connects as an object to push away from, which supplements the proper action of the pose; (5) reclining pose—by providing lift to allow for greater hip and total front body openings and by supplementing with the exercise platform's exercise tubes so as to provide an anchored pose and additional lengthening and stretching capability; and (6) meditation chair—by providing varying degrees of lift for practitioners with varying degrees of flexibility so that the position is comfortable yet challenging.

Other features and advantages of the present invention will become apparent from the subsequent description, taken in conjunction with the accompanying drawings.

BRIEF DESCRIPTION OF THE DRAWINGS

FIGS. 3A, 3B, 3C, 3D and 3E illustrate a top view of a top surface, a side view of an exterior side wall, a front perspective view without exercise tubes, a front perspective view with exercise tubes and a back perspective view with exercise tubes of a third embodiment of the exercise platform of the present invention.

FIGS. 7A and 7B illustrate a front perspective view and back perspective view of an embodiment of the present invention.

DETAILED DESCRIPTION OF THE INVENTION

Figure 1A:
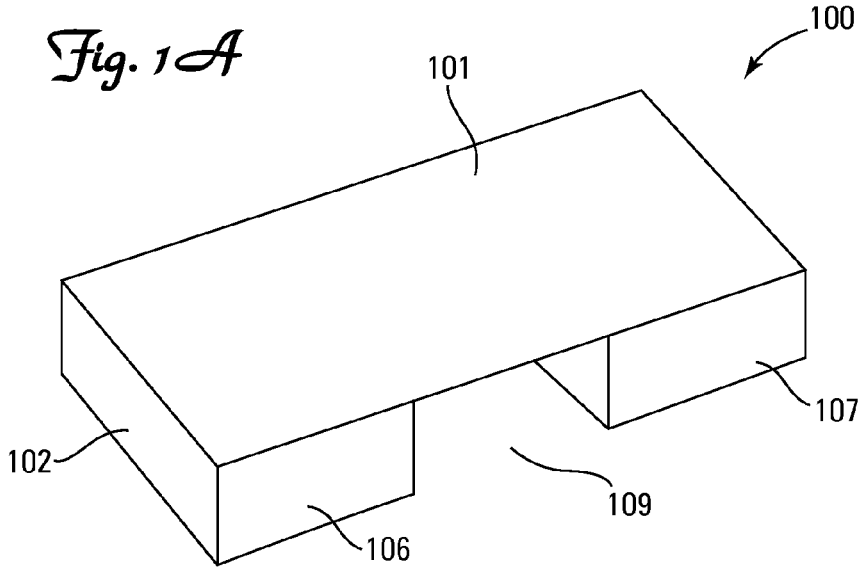
FIGS. 1A, 1B, and 1C illustrate a front perspective view, a back perspective view, and a bottom view of one embodiment of an exercise platform of the present invention.
Figure 1B:
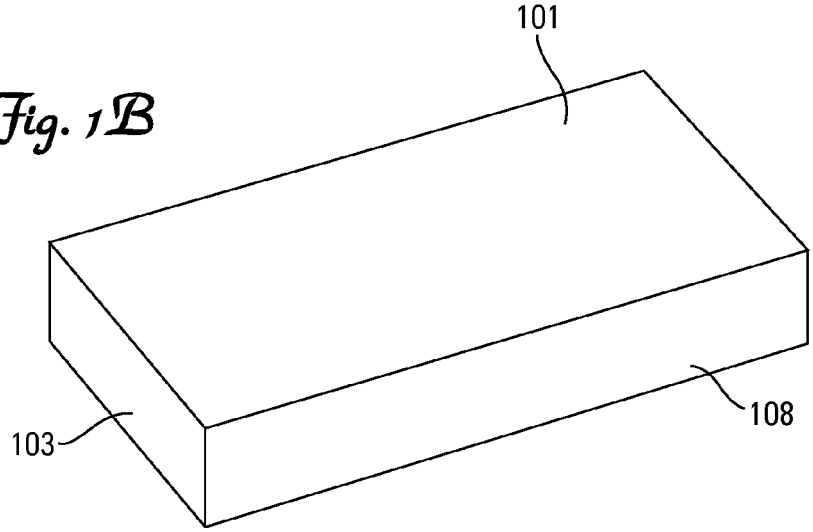
Figure 1C:
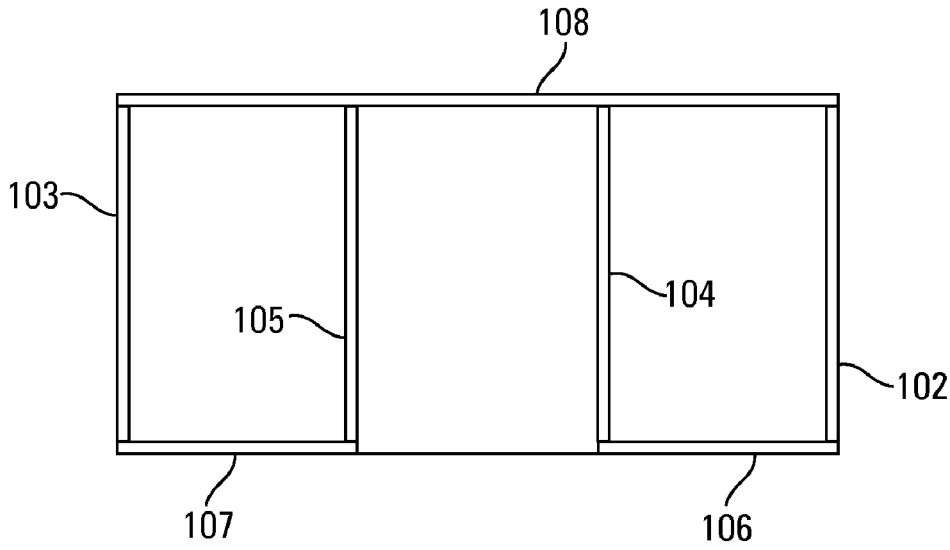

Referring now to the drawings, and in particular FIGS. 1A-C, an embodiment of the invention is shown generally as exercise platform 100 being made of wood, plastic or some other durable solid material and having parallel exterior side walls 102 and 103, interior side walls 104 and 105 which are parallel with exterior side walls 102 and 103, back wall 108 which is parallel with front walls 106 and 107 and perpendicular to exterior side walls 102 and 103 and interior side walls 104 and 105, front wall 106 being the selected space between exterior side wall 102 and interior side wall 104, and front wall 107 being the selected space between exterior side wall 103 and interior side wall 105 (as shown in FIG. 1C). These walls are sturdy enough to support a large human being that is standing or sitting on top surface 101 which is parallel to the ground or floor and perpendicular to walls 102, 103, 104, 105, 106, 107 and 108. A hollow recess 109 is shown in FIG. 1A and is enclosed vertically on three sides by interior side walls 104, 105 and back wall 108 as well as being enclosed by top surface 101. The hollow recess 109 is sized in length and width to comfortably accommodate, for use and storage, the incline base described herein.

Figure 2A:
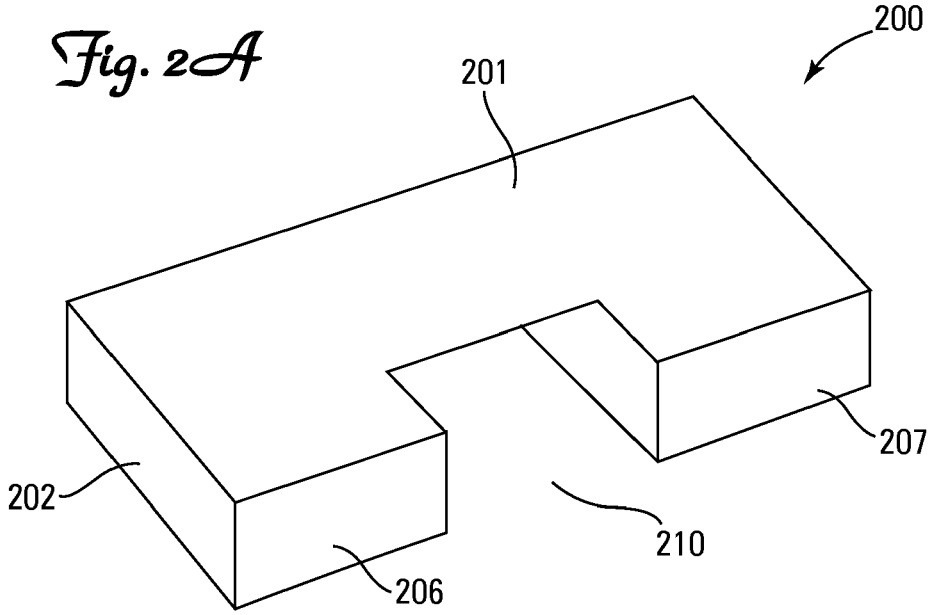
FIGS. 2A, 2B, 2C and 2D illustrate a front perspective view, a back perspective view, a bottom view and a top view of a second embodiment of the exercise platform of the present invention.
Figure 2B:
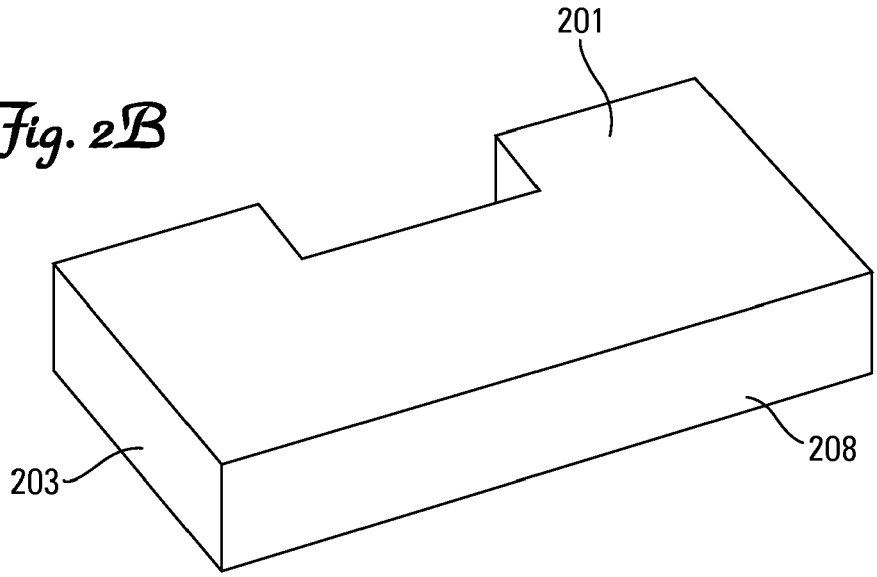
Figure 2C:
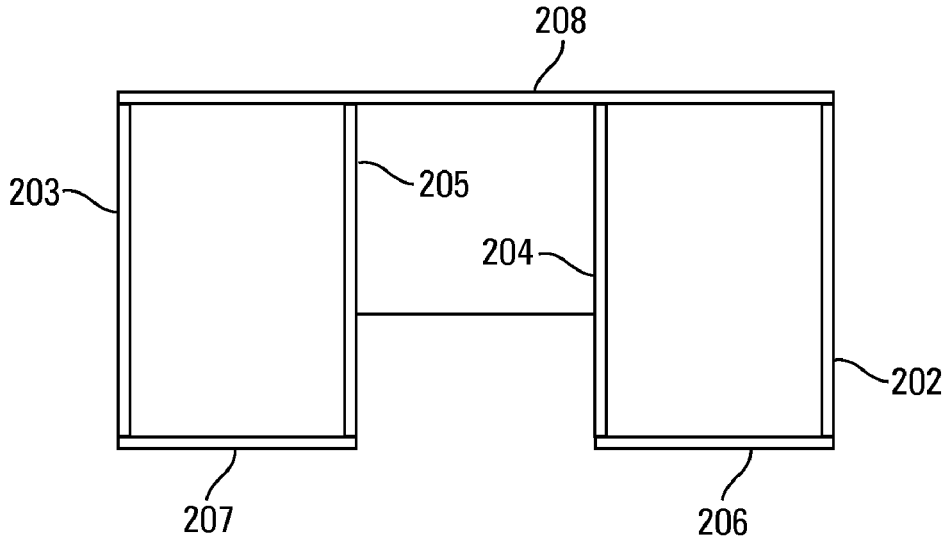
Figure 2D:
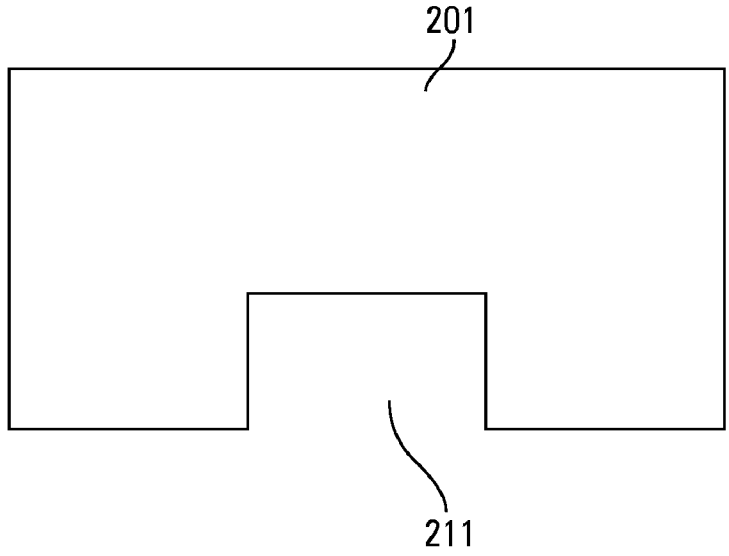

FIGS. 2A-2D show an alternative embodiment of the exercise platform of the present invention which is similar to the embodiment of exercise platform 100, and is shown generally as exercise platform 200 being made of wood, plastic or some other solid durable material, having parallel exterior side walls 202 and 203, interior side walls 204 and 205 which are parallel with exterior side walls 202 and 203, back wall 208 which is parallel with front walls 206 and 207 and perpendicular to exterior side walls 202 and 203 and interior side walls 204 and 205, front wall 206 being the selected space between exterior side wall 202 and interior side wall 204, and front wall 207 being the selected space between exterior side wall 203 and interior side wall 205. These walls are sturdy enough to support a large human being that is standing or sitting on top surface 201 which is parallel to the ground or floor and perpendicular to walls 202, 203, 204, 205, 206, 207 and 208. A hollow recess 210 is enclosed vertically on three sides by interior side walls 204, 205 and back wall 208 as well as being enclosed partially by top surface 201 by a predetermined length. The predetermined length being the area remaining after recessed portion 211 has been removed from the top surface (as shown in FIG. 2D), recessed portion 211 giving the exercise platform a rectilinear U-shape as well as giving the hollow recess 210 a top opening. Recessed portion 211 and hollow recess 210 are sized in length and width to comfortably accommodate both feet of a practitioner in a standing position for use as a step down and to accommodate, for use and storage, the incline base described herein.

Figure 3A:
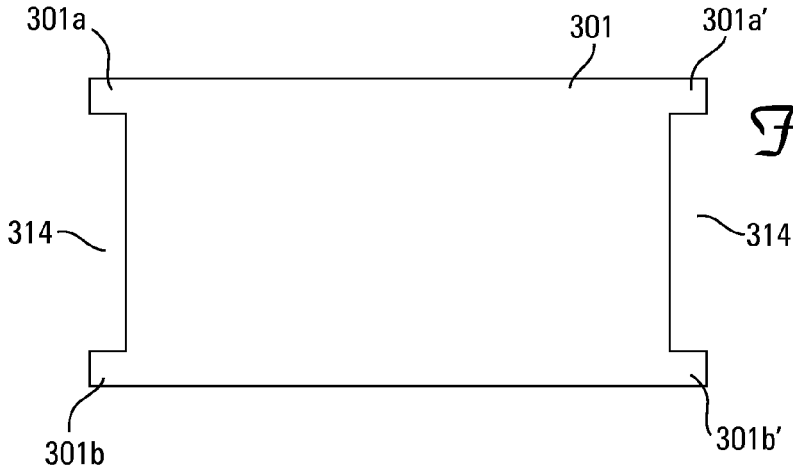
Figure 3B:
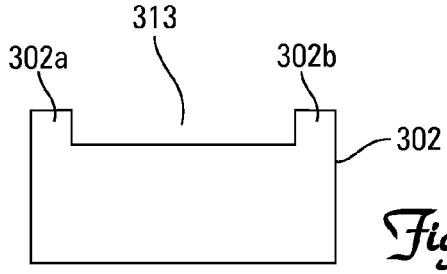
Figure 3C:
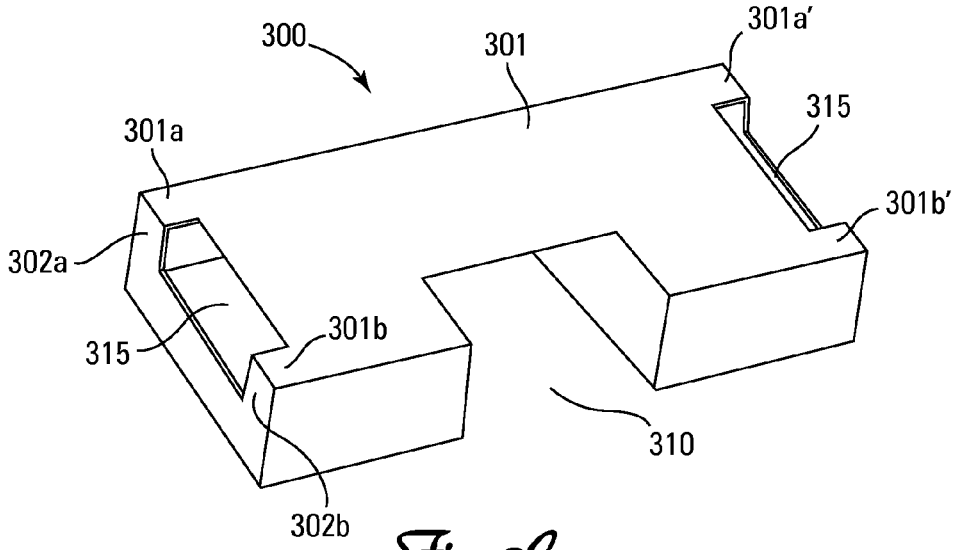

FIGS. 3A-3E show an alternative embodiment of the exercise platform of the present invention which is similar to the embodiment of exercise platform 200 and is shown generally as exercise platform 300 being made of wood, plastic or some other durable solid material, having parallel exterior side walls 302 and 303, interior side walls 304 and 305 which are parallel with exterior side walls 302 and 303, back wall 308 which is parallel with front walls 306 and 307 and perpendicular to exterior side walls 302 and 303 and interior side walls 304 and 305, front wall 306 being the selected space between exterior side wall 302 and interior side wall 304, and front wall 307 being the selected space between exterior side wall 303 and interior side wall 305. These walls are sturdy enough to support a large human being that is standing or sitting on top surface 301 which is parallel to the ground or floor and perpendicular to walls 302, 303, 304, 305, 306, 307 and 308. A hollow recess 310 is enclosed vertically on three sides by interior side walls 304, 305 and back wall 308 as well as being enclosed partially by the top surface 301 by a predetermined length. Exterior vertical side walls 302 (as shown in FIG. 3B) and 303 have recessed portions 313 removed from the upper portion of each exterior side wall 302 and 303 forming projections 302*a*, 302*b*, 303*a* and 303*b*, projections 302*a* and 303*a* being attached vertically to back wall 308, and projection 302*b* being attached vertically to front wall 306 and projection 303*b* being vertically attached to front wall 307. Top surface 301 has recessed portions 314 forming projections 301*a*, 301*b*, 301*a*', and 301*b*', projections 301*a* and 301*b* being perpendicularly attached to projections 302*a* and 302*b* respectively, and projections 301*a*' and 301*b*' being perpendicularly attached to projections 303*a* and 303*b* respectively (as shown in FIG. 3A). Recessed portions 313 and 314 align perpendicularly to form rectilinear cavities 315 (as shown in FIG. 3C). Exercise tubes 316 are configured to fit into rectilinear cavities 315, the exercise tubes 316 being fastened to back wall 308 and front walls 306 and 307 respectively (as shown in FIGS. 3D and 3E) and can be made from rubber or hard plastic. The exercise tubes could also be fastened to the inside of exterior side walls 302 and 303.

Figure 4A:
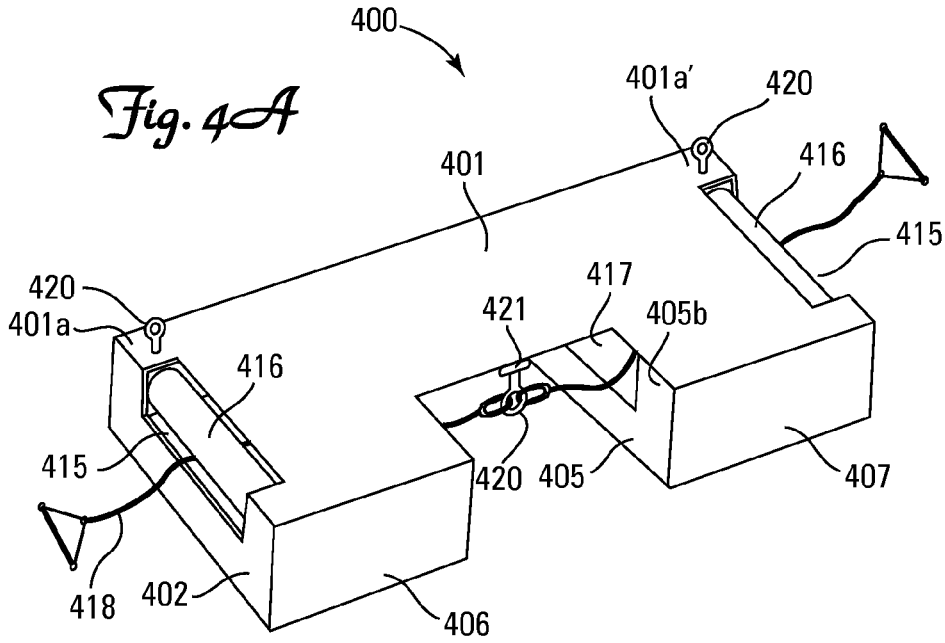
FIGS. 4A, 4B, 4C, 4D, and 4E illustrate a front perspective view, a back perspective view, two side views of interior side walls, and a perspective view of a pull ring of a fourth embodiment of the exercise platform of the present invention.
Figure 4B:
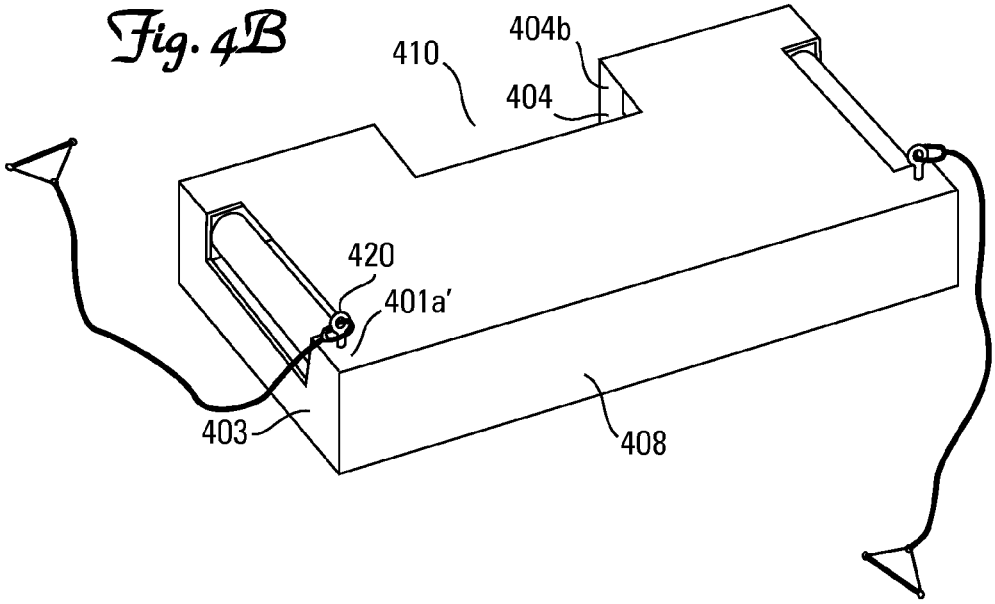
Figure 4C:
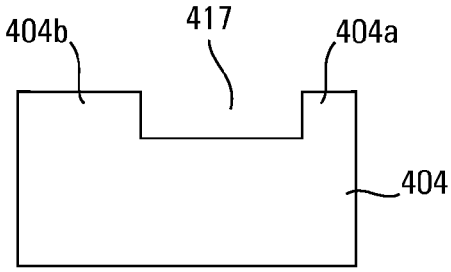
Figure 4D:
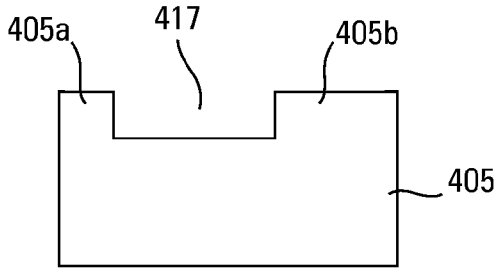
Figure 4E:
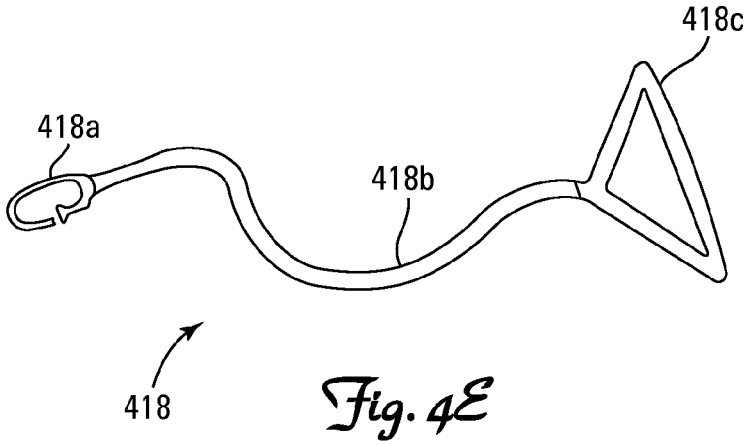

FIGS. 4A-4E show an alternative embodiment of the exercise platform of the present invention which is similar to the embodiment of exercise platform 300, and is shown generally as exercise platform 400 being made of wood, plastic or some other durable solid material, having parallel exterior side walls 402 and 403, interior side walls 404 and 405 which are parallel with exterior side walls 402 and 403, back wall 408 which is parallel with front walls 406 and 407 and perpendicular to exterior side walls 402 and 403 and interior side walls 404 and 405, front wall 406 being the selected space between exterior side wall 402 and interior side wall 404, and front wall 407 being the selected space between exterior side wall 403 and interior side wall 405. These walls are sturdy enough to support a large human being that is standing or sitting on top surface 401 which is parallel to the ground or floor and perpendicular to walls 402, 403, 404, 405, 406, 407 and 408. A hollow recess 410 is enclosed vertically on three sides by interior side walls 404, 405 and back wall 408 as well as being enclosed partially by the top surface by a predetermined length. Rectilinear cavities 415 contain exercise tubes 416. Fasteners 420 can be attached onto the exercise platform at various locations and most preferably on projections 401*a* and 401*a*' of top surface 401 and to the underside of top surface 401 and into a fastener support 421 centrally located in hollow recess 410. The fasteners 420 can be made from a metallic material and are used for attaching pulls rings 418 to the exercise platform. Interior vertical walls 404 and 405 have recessed portions 417 removed from the upper portions of each interior side wall creating projections 404*a*, 404*b*, 405*a* and 405*b* (as shown in FIGS. 4C and 4D), projections 404*a* and 405*a* being attached to back wall 408, projection 404*b* being attached to front wall 406, and projection 405*b* being attached to front wall 407. The pull rings 418 fastened to the underside of the top surface can be thread through recessed portion 417 and through rectilinear void 415 to be used to enhance and develop exercise workout and routines (as shown in FIG. 4A). The pull rings 418 can also be attached to fasteners 420 located on projections 401*a* and 401*a*' to vary exercises and workouts (as shown in FIG. 4B). The pull rings, as shown in FIG. 4E, have a cord 418*b* (which can be made from elastic material such as that used in a bungee cord or rubber) that is attached at one end to clip 418*a* (which can be made from a metallic material or hard plastic) and at the opposite end to handle 418*c* (which can be made from a metallic material or hard plastic).

Figure 5A:
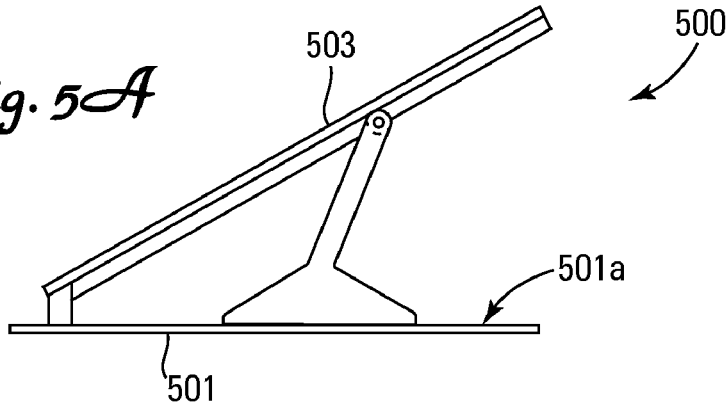
FIGS. 5A, 5B and 5C illustrate a side view with a degree of incline, a side view with no incline (slant board is in resting position), and a bottom view of an embodiment of the incline base of the present invention.
Figure 5B:
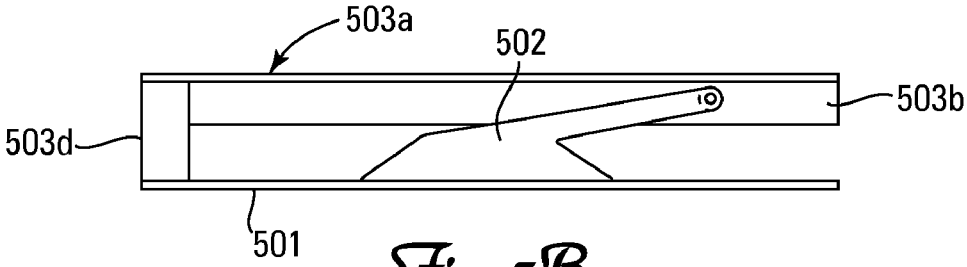
Figure 5C:
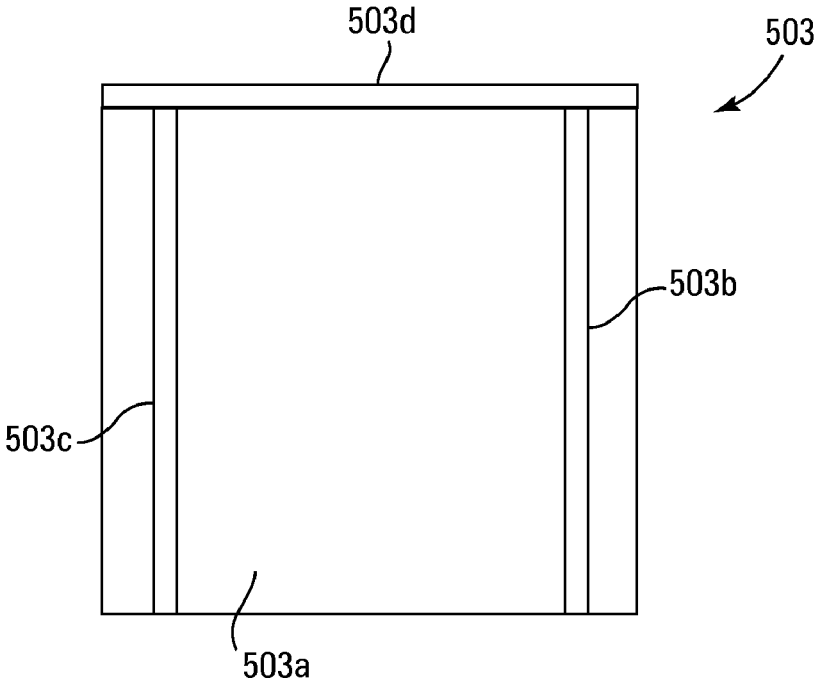

Referring to FIGS. 5A-C, another embodiment of the present invention is shown generally as incline base 500, having platform 501 being connected by adjustable sliding fasteners 502 to slant board 503. The slant board 503 has top surface 503*a* which is attached on the underside to two side walls 503*b* and 503*c*, which are parallel to each other and recessed a predetermined distance from the side edges of top surface 503*a*, and front wall 503*d* being attached perpendicularly to side walls 503*b* and 503*c* as well as to the front underside of top surface 503*a* (as shown in FIG. 5C). Sliding fasteners 502 are connected to slant board 503's recessed side walls 503*b* and 503*c* as well as to a top surface 501*a* of platform 501 (as shown FIG. 5A). The slide fasteners, which can be made from a metallic material, are adjustable, and allow the slant board 503 to have varying degrees of incline, from a complete resting position where the slant board 503 is sitting parallel to the top surface 501*a* of platform 501 (as shown in FIG. 5B), to gradual degrees of incline, to a sharp slope, the degree of incline being chosen in accordance with the practitioner's flexibility, desired workout routine, degree of difficulty and other factors. The incline base is designed to fit into the hollow recess 109 of exercise platform 100 and the hollow recesses 210, 310, and 410 of exercise platforms 200, 300 and 400 for use and storage. Incline base 500 also can also be used as an addition to the top surface of exercise platform 100. The incline base 500 of the present feature being used in combination with or separable from the exercise platform features of the invention to enhance and develop various exercise routines such as yoga and meditation poses as well as other various workouts.

Figure 6A:
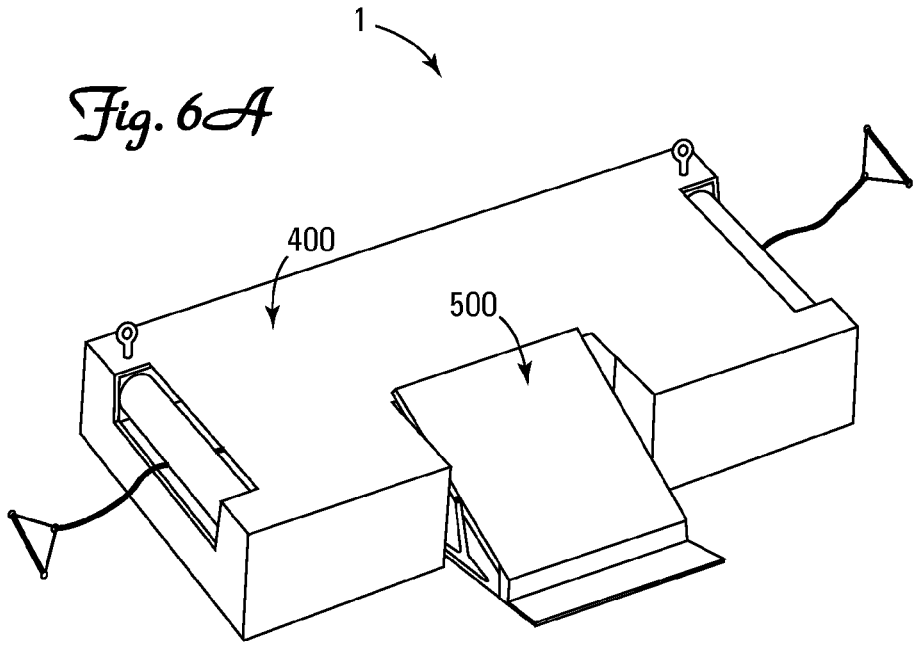
FIGS. 6A and 6B illustrate a front perspective view and back perspective view of an embodiment of the present invention.
Figure 6B:
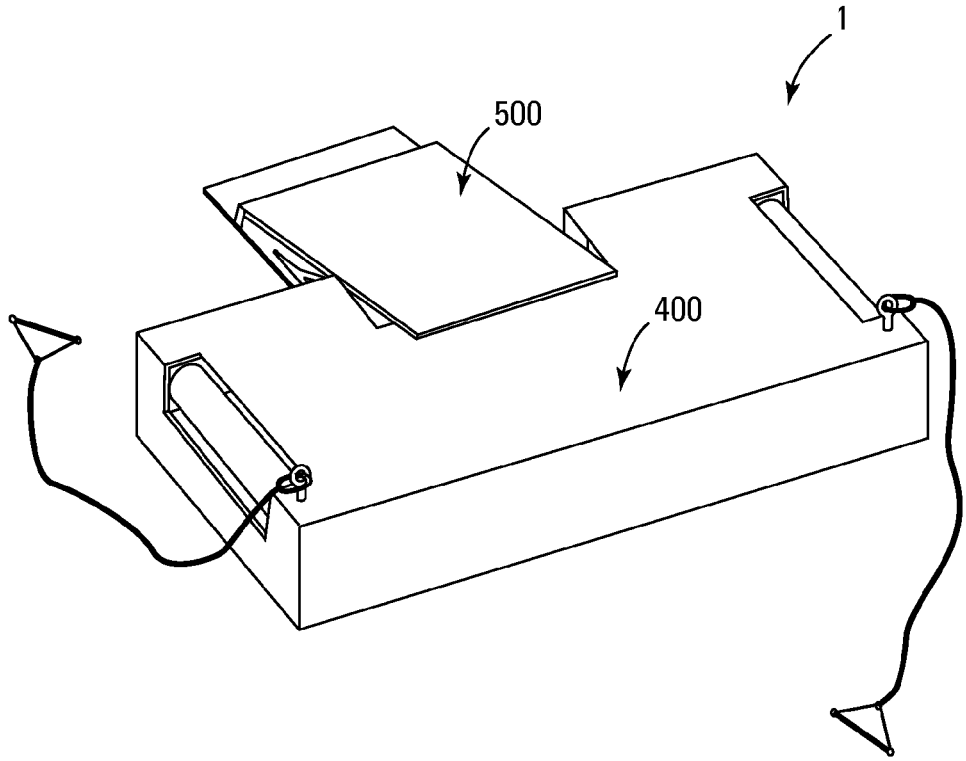

FIGS. 6A and 6B show a preferred embodiment of the present invention which is presented generally as yoga prop 1 and shows exercise platform 400 being used in combination with incline base 500, which is sized to fit within hollow recess 410 of exercise platform 400 with varying degrees of incline.

FIGS. 7A and 7B show an alternative embodiment of the present invention which is presented generally as yoga prop 2 and shows exercise platform 100 being used in combination with incline base 500.

Figure 8:
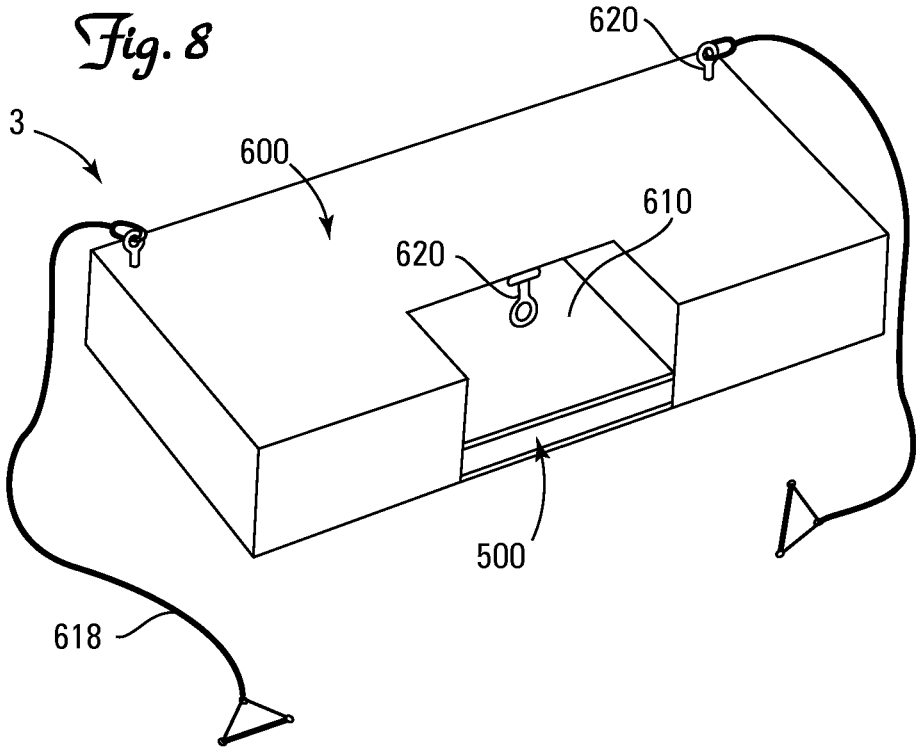
FIG. 8 illustrates a front perspective view of an embodiment of the present invention.

FIG. 8 is an alternative embodiment of the present invention which is presented generally as yoga prop 3 and shows incline base 500 being stored in a resting position, incline base 500 being sized fit into hollow recess 610 of alternate exercise platform embodiment 600 which has fasteners 620 and pull rings 618.

Figure 9:
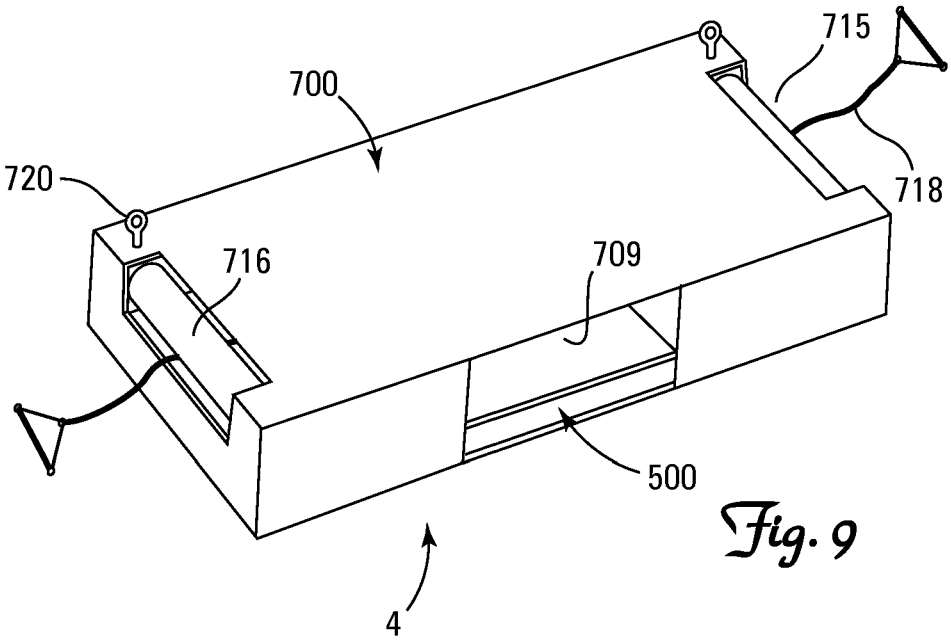
FIG. 9 illustrates a front perspective view of an embodiment of the present invention.

FIG. 9 is an alternative embodiment of the present invention which is presented generally as yoga prop 4 and shows incline base 500 being stored in a resting position and being sized to fit into hollow recess 709 of alternate exercise platform embodiment 700 which has fasteners 720, pull rings 718, recessed cavities 715 and exercise tubes 716.

Although particular embodiments have been disclosed herein in detail, this has been done for purposes of illustration only, and is not intended to be limiting with respect to the scope of the claims. In particular, it is contemplated by the inventor that various substitutions, alterations and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. An incline base comprising:

a slant board with a top surface and two opposing side walls on the underside of the top surface;

a base platform; and opposed sliding fasteners that are apically connected to the side walls of the slant board and terminally connected to the base platform.

2. The incline base of claim 1 wherein the sliding fasteners adjust the angle of the slant board relative to the base platform to variable degrees of incline.

3. An exercise device comprising:

an exercise platform having a top surface opposed to a ground surface, first and second opposing exterior side walls, first and second opposing interior side walls, a first front wall perpendicular to the first interior and first exterior side walls, a second front wall perpendicular to the second interior and second exterior side walls and a back wall opposed to the first and second front walls; and an incline base having a slant board with a top surface, two opposing side walls on the underside of the top surface, a base platform and opposed sliding fasteners that are apically connected to the side walls of the slant board and terminally connected to the base platform.

4. The exercise device of claim 3 wherein the sliding fasteners of the incline base adjust the angle of the slant board relative to the base platform to variable degrees of incline.

5. The exercise device of claim 3 wherein at least one pull ring is attached to at least one of a plurality of fasteners connected to the top surface of the exercise platform.

6. The exercise device of claim 3 wherein a first and a second side of the top surface of the exercise platform have a recessed portion and an upper end of the first and second exterior side walls of the exercise platform has a recessed portion thereby creating a first and a second side cavity, the first side cavity containing a first exercise tube and the second side cavity containing a second exercise tube.

7. The exercise device of claim 6 wherein at least one pull ring is attached to at least one of a plurality of fasteners connected to the top surface of the exercise platform.

8. The exercise device of claim 3 wherein the width of the incline base is sized to fit between the first and second interior walls of the exercise platform.

9. An exercise device comprising:

an exercise platform having a rectilinear U-shaped top surface opposed to a ground surface, first and second opposing exterior side walls, first and second opposing interior side walls, a first front wall perpendicular to the first interior and first exterior side walls, a second front wall perpendicular to the second interior and second exterior side walls and a back wall opposed to the first and second front walls; and an incline base having a slant board with a top surface, two opposing side walls on the underside of the top surface, a base platform and opposed sliding fasteners that are apically connected to the side walls of the slant board and terminally connected to the base platform.

10. The exercise device of claim 9 wherein the sliding fasteners of the incline base adjust the angle of the slant board relative to the base platform to variable degrees of incline.

11. The exercise device of claim 9 wherein at least one pull ring is attached to at least one of a plurality of fasteners connected to the rectilinear U-shaped top surface of the exercise platform.

12. The exercise device of claim 9 wherein a first and a second side of the rectilinear U-shaped top surface of the exercise platform have a recessed portion and an upper end of the first and second exterior side walls of the exercise platform has a recessed portion thereby creating a first and a second side cavity, the first side cavity containing a first exercise tube and the second side cavity containing a second exercise tube.

13. The exercise device of claim 12 wherein at least one pull ring is attached to at least one of a plurality of fasteners connected to the rectilinear U-shaped top surface of the exercise platform.

14. The exercise device of claim 9 wherein the width of the incline base is sized to fit between the first and second interior walls of the exercise platform.

* * * * *